US008287290B2

(12) United States Patent
Cohen

(10) Patent No.: US 8,287,290 B2
(45) Date of Patent: Oct. 16, 2012

(54) DEVICE, SYSTEM AND METHOD OF AN INTERFACE CONNECTOR

(75) Inventor: Mitchell Dean Cohen, Carson City, NV (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/022,808

(22) Filed: Feb. 8, 2011

(65) Prior Publication Data

US 2012/0202362 A1 Aug. 9, 2012

(51) Int. Cl.
*H01R 12/00* (2006.01)

(52) U.S. Cl. ..... 439/66

(58) Field of Classification Search ..... 439/60–61, 439/66

See application file for complete search history.

(56) References Cited

U.S. PATENT DOCUMENTS

| | | | | |
|---|---|---|---|---|
| 5,313,614 | A | 5/1994 | Goettelmann et al. | |
| 5,539,787 | A | 7/1996 | Nakano et al. | |
| 5,551,015 | A | 8/1996 | Goettelmann et al. | |
| 5,581,558 | A | 12/1996 | Horney, II et al. | |
| 5,694,580 | A | 12/1997 | Narita et al. | |
| 5,960,182 | A | 9/1999 | Matsuoka et al. | |
| 5,963,740 | A | 10/1999 | Srivastava et al. | |
| 6,151,390 | A | 11/2000 | Volftsun et al. | |
| 6,237,053 | B1 | 5/2001 | Herrod et al. | |
| 6,493,594 | B1 | 12/2002 | Kraml | |
| 7,052,284 | B2 * | 5/2006 | Liao et al. | 439/66 |
| 7,188,171 | B2 | 3/2007 | Srinivasan et al. | |
| 7,341,485 | B2 * | 3/2008 | Polnyi | 439/591 |
| 7,503,770 | B2 * | 3/2009 | Fan | 439/66 |
| 7,692,281 | B2 * | 4/2010 | McAlonis et al. | 257/690 |
| 7,780,456 | B2 * | 8/2010 | Chen et al. | 439/66 |

* cited by examiner

*Primary Examiner* — Truc Nguyen

(74) *Attorney, Agent, or Firm* — Global Patent Operation; Mark A. Conklin

(57) ABSTRACT

Embodiments of the invention described herein a device, method and system of connecting a first circuit board and a second circuit board using an interface connector. In one aspect, an interface connector is described that is comprised of a casing and a plurality of electrically conductive connectors insulated from one another within the casing. Each connector has a first end and a second end, wherein the first end connects to a first circuit board and the second end connects to a second circuit board. The plurality of connectors form a first row and a second row of the interface connector. The first row is comprised of evenly-numbered connectors and the second row is comprised of odd-numbered connectors. The plurality of connectors are assigned as follows: connectors 1-4, 13-18, 43-61, 68-71, 77, 78, 79, 80, 84, 86, 92 and 94-120 provide electrical paths for general circuit connections between the first circuit board and the second circuit board; connectors 41, 42, 62-67, 72-75 and 81 provide electrical paths for host processor connections between the first circuit board and the second circuit board; and connectors 5-12, 19-40, 76, 82, 83, 85, 87-91 and 93 provide electrical paths for field programmable gate array (FPGA) connections between the first circuit board and the second circuit board.

16 Claims, 5 Drawing Sheets

DEVICE, SYSTEM AND METHOD OF AN INTERFACE CONNECTOR

BACKGROUND OF THE INVENTION

The present application relates generally to interface connectors and, more particularly, to an interface connector for use in upgrading a monitoring system.

Known machines may exhibit vibrations or other abnormal behavior during operation. One or more sensors may be used to measure and/or monitor such behavior and to determine, for example, an amount of vibration exhibited in a motor drive shaft, a rotational speed of the motor drive shaft, and/or any other suitable operational characteristic of an operating machine or motor. Often, sensors are coupled to a monitoring system that includes a plurality of monitors. At least some known monitoring systems receive signals representative of measurements from one or more sensors, and in response, perform at least one processing step on the signals, prior to transmitting the modified signals to a diagnostic platform that displays the measurements to a user in a format usable by the user.

In some instances, it is desired to upgrade such monitoring systems as machines are replaced or improved and as technology advances. Rather than "rip and tear" out the old system, it may be more efficient and timely to upgrade the existing monitoring system by upgrading components. In some instances, modules used for monitoring purposes by the monitoring systems can be enhanced through the addition of electronic components such as processors, field programmable gate arrays (FPGAs), resistors, capacitors, inductors, memory and the like. In some instances, it may be necessary to expand the original circuit board of the monitoring module by adding a second circuit board that comprises the new electronic components.

Therefore, devices, systems and methods are desired that overcome challenges in the art, some of which are described above. Specifically, devices, systems and methods are desired for connecting a first circuit board and a second circuit board using an interface connector.

BRIEF DESCRIPTION OF THE INVENTION

Described herein are embodiments of devices, methods and systems for connecting two circuit boards using an interface connector.

In one aspect, an interface connector for connecting two circuit boards is described. One embodiment of an interface connector is comprised of a casing and a plurality of electrically conductive connectors insulated from one another within the casing. Each connector has a first end and a second end. The first end connects to a first circuit board and the second end connects to a second circuit board. The plurality of connectors of the interface connector form a first row and a second row. The first row is comprised of even-numbered connectors and said second row is comprised of odd-numbered connectors and the plurality of connectors are assigned as follows: connectors 1-4, 13-18, 43-61, 68-71, 77, 78, 79, 80, 84, 86, 92 and 94-120 provide electrical paths for general circuit connections between the first circuit board and the second circuit board; connectors 41, 42, 62-67, 72-75 and 81 provide electrical paths for host processor connections between the first circuit board and the second circuit board; and connectors 5-12, 19-40, 76, 82, 83, 85, 87-91 and 93 provide electrical paths for field programmable gate array (FPGA) connections between the first circuit board and the second circuit board.

In another aspect, a method of connecting two circuit boards is described. One embodiment of the method comprises providing an interface connector. The embodiment of an interface connector is comprised of a casing and a plurality of electrically conductive connectors insulated from one another within the casing. Each connector has a first end and a second end. The first end connects to a first circuit board and the second end connects to a second circuit board. The plurality of connectors form a first row and a second row where the first row is comprised of even-numbered connectors and the second row is comprised of odd-numbered connectors. The interface connector is configured such that said the plurality of connectors are assigned as follows: connectors 1-4, 13-18, 43-61, 68-71, 77, 78, 79, 80, 84, 86, 92 and 94-120 provide electrical paths for general circuit connections between the first circuit board and the second circuit board; connectors 41, 42, 62-67, 72-75 and 81 provide electrical paths for host processor connections between the first circuit board and the second circuit board; and connectors 5-12, 19-40, 76, 82, 83, 85, 87-91 and 93 provide electrical paths for field programmable gate array (FPGA) connections between the first circuit board and the second circuit board. The first circuit board and the second circuit board are connected using the configured interface connector.

In yet another aspect, a system is described. One embodiment of the system is comprised of an interface connector, a first circuit board, and a second circuit board. The interface connector is used to connect the first circuit board to the second circuit board. The interface connector is comprised of a casing and at least 120 electrically conductive connectors insulated from one another within the casing. Each connector has a first end and a second end. The first end connects to the first circuit board and the second end connects to the second circuit board. The plurality of connectors form a first row and a second row where the first row is comprised of even-numbered connectors and said the second row comprised of odd-numbered connectors. The plurality of connectors are configured as follows: connectors 1-4, 13-18, 43-61, 68-71, 77, 78, 79, 80, 84, 86, 92 and 94-120 provide electrical paths for general circuit connections between the first circuit board and the second circuit board, wherein connectors 59, 61, 79, 18, 60, 80, 110, 69, 71, 68, 70, 77, and 78 are power connections for electronic components on the first circuit board or the second circuit board and connectors 1-4 provide electrical paths for a plurality of keyphasor signals between the first circuit board and the second circuit board; connectors 41, 42, 62-67, 72-75 and 81 provide electrical paths for host processor connections between the first circuit board and the second circuit board, wherein connector 63 provides the electrical path for a clock signal between the first circuit board and the second circuit board; and connectors 5-12, 19-40, 76, 82, 83, 85, 87-91 and 93 provide electrical paths for field programmable gate array (FPGA) connections between the first circuit board and the second circuit board.

Additional advantages will be set forth in part in the description which follows or may be learned by practice. The advantages will be realized and attained by means of the elements and combinations particularly pointed out in the appended claims. It is to be understood that both the foregoing general description and the following detailed description are exemplary and explanatory only and are not restrictive, as claimed.

BRIEF DESCRIPTION OF THE DRAWINGS

The accompanying drawings, which are incorporated in and constitute a part of this specification, illustrate embodiments and together with the description, serve to explain the principles of the methods and systems.

DETAILED DESCRIPTION OF THE INVENTION

Figure 1:
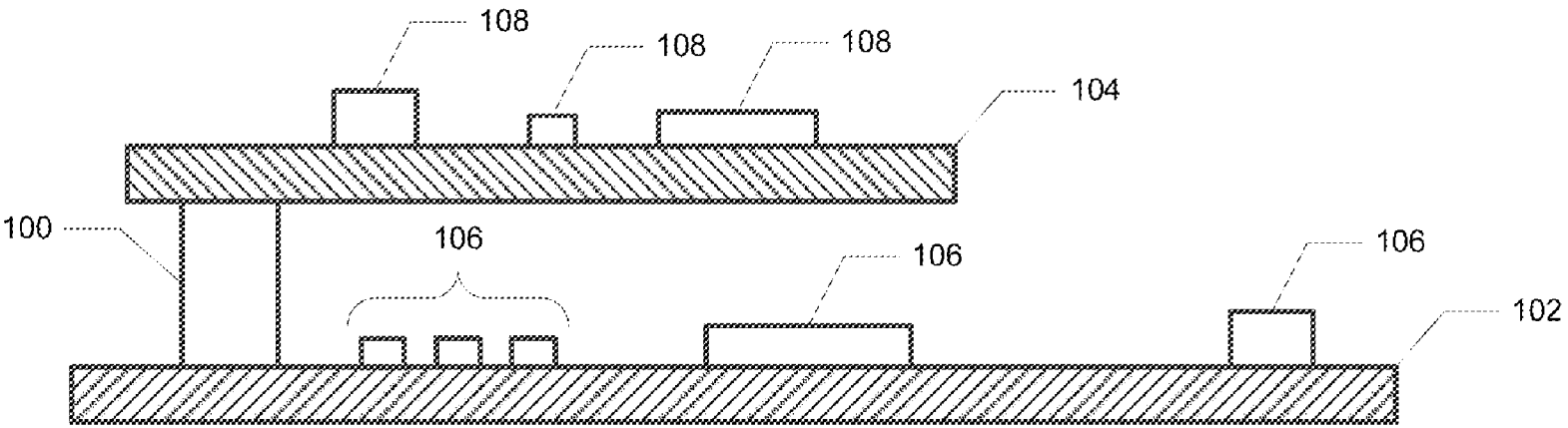
FIG. 1 illustrates an embodiment of an interface connector for electrically connecting a first circuit board to a second circuit board.

Before the present methods and systems are disclosed and described, it is to be understood that the methods and systems are not limited to specific synthetic methods, specific components, or to particular compositions. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. Further, when examples of ranges are provided herein, it is to be appreciated that the given ranges also include all subranges therebetween, unless specifically stated otherwise.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all devices, methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems may be understood more readily by reference to the following detailed description of preferred embodiments and the Examples included therein and to the Figures and their previous and following description.

FIG. 1 illustrates an embodiment of an interface connector 100 for electrically connecting a first circuit board 102 to a second circuit board 104. The interface connector 100 provides a bridge for electrical circuits associated with electrical components 106 on the first board 102 to connect with electrical circuits associated with electrical components 108 on the second board. The circuit boards 102, 104 are as known to one of ordinary skill in the art and generally comprise a non-conductive base on which electronic components 106, 108 such as resistors, capacitors, processors, field programmable gate arrays (FPGAs) and the like are attached and interconnected through conductive paths. Generally, in one aspect the interface connector is comprised of a casing and a plurality of electrically conductive connectors insulated from one another within the casing. In one aspect, embodiments of the interface connector 100 can be used in a machine monitoring system such as those manufactured by General Electric Company, Schenectady, N.Y. ("GE"). In one aspect, embodiments of the interface connector can be used to upgrade monitoring modules used in machine monitoring systems. Such machine monitoring systems and upgrading monitoring modules are described in U.S. patent application Ser. No. 12/885,992, filed Sep. 20, 2010, which is fully incorporated herein by reference and made a part hereof. In one aspect, the first circuit board 102 is an ancillary board for a Bently-Nevada machinery protection and monitoring system (Bently Nevada is a trademark of the General Electric Company). In one aspect, the second circuit board 104 is a portable core module (PCM) used to upgrade a Bently Nevada model 3300 machinery protection and monitoring system to a Bently Nevada model 3500 machinery protection and monitoring system. In one aspect, the PCM is a microprocessor based module that performs core monitoring and protection functions that can easily be portable to many platforms. In this aspect, the interface connector 100 serves as a portable core module interface connector between an ancillary board and a portable core module for a Bently Nevada machinery protection and monitoring system, though other uses and applications are considered within the scope of embodiments of this invention.

Figure 2:
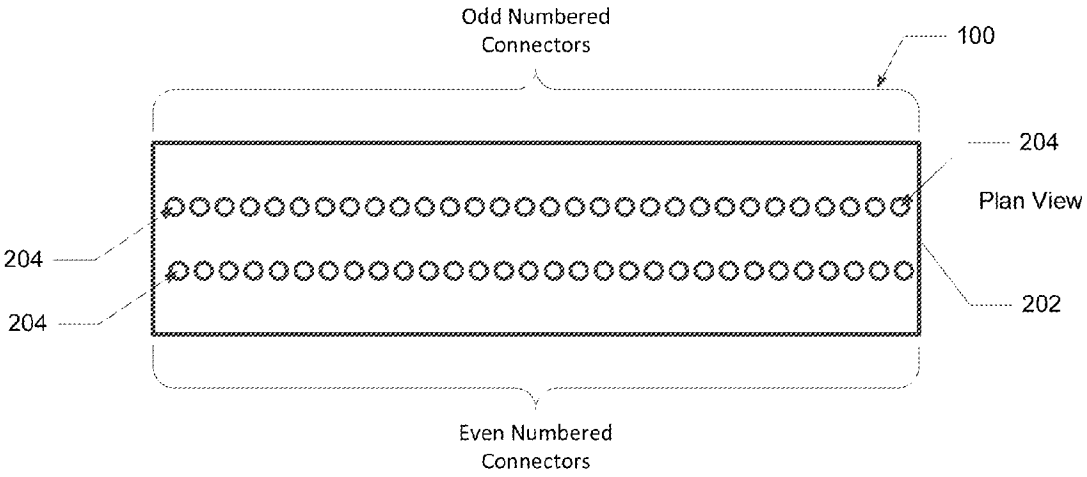
FIG. 2 illustrates a plan view of one embodiment of an interface connector for electrically connecting a first circuit board to a second circuit board.

FIG. 2 illustrates a plan view of one embodiment of an interface connector 100 for electrically connecting a first circuit board 102 to a second circuit board 104. As shown in FIG. 2, this embodiment of an interface connector 100 is comprised of a casing 202; and a plurality of electrically conductive connectors 204 insulated from one another within the casing 202, each connector 204 having a first end and a second end. In one aspect, the first end of a connector 204 connects to the first circuit board 102 and the second end of a connector 204 connects to the second circuit board 104. As shown in FIG. 2, the plurality of connectors 204 form a first row and a second row. In one aspect, the first row is comprised of even numbered connectors 204 and the second row is comprised of odd-numbered connectors. For example, the evenly numbered connectors can be 2, 4, 6, 8, 10, etc. The odd numbered connectors 204 can be 1, 3, 5, 7, 9, 11, etc.

Figure 3:
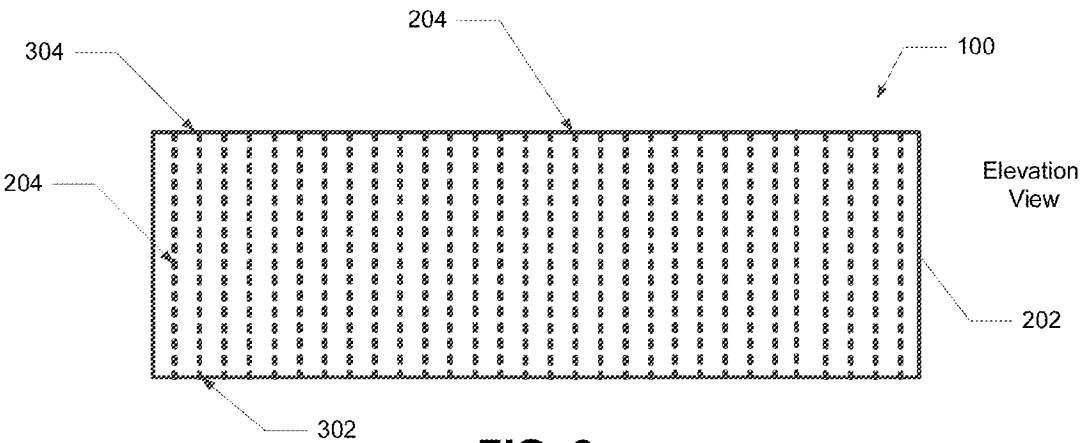
FIG. 3 illustrates an elevation view of one embodiment of an interface connector for electrically connecting a first circuit board to a second circuit board.

FIG. 3 illustrates an elevation view of one embodiment of an interface connector 100 for electrically connecting a first circuit board 102 to a second circuit board 104. As shown in FIG. 3, the connectors 204 extend through the casing 202, each forming an electrically conductive path to connect circuits on the first circuit board 102 with circuits in the second circuit board 104. As noted above, each connector 204 has a first end 302 and a second end 304. The first ends 302 and second ends 304 of the connectors 204 can be male or female as needed to interface with the circuit boards 102, 104. In one aspect, the first end 302 of each of the plurality of connectors 204 comprises a female end for connecting to the first circuit board 102. In another aspect, the first end 302 of each of the plurality of connectors 204 comprises a male end for connecting to the first circuit board 102. In one aspect, the second end 304 of each of the plurality of connectors 204 comprises a female end for connecting to the second circuit board 104. In another aspect, the second end 304 of each of the plurality of connectors 204 comprises a male end for connecting to the second circuit board 104. Other types of connector ends are also contemplated within the scope of embodiments of this invention.

Figure 4:
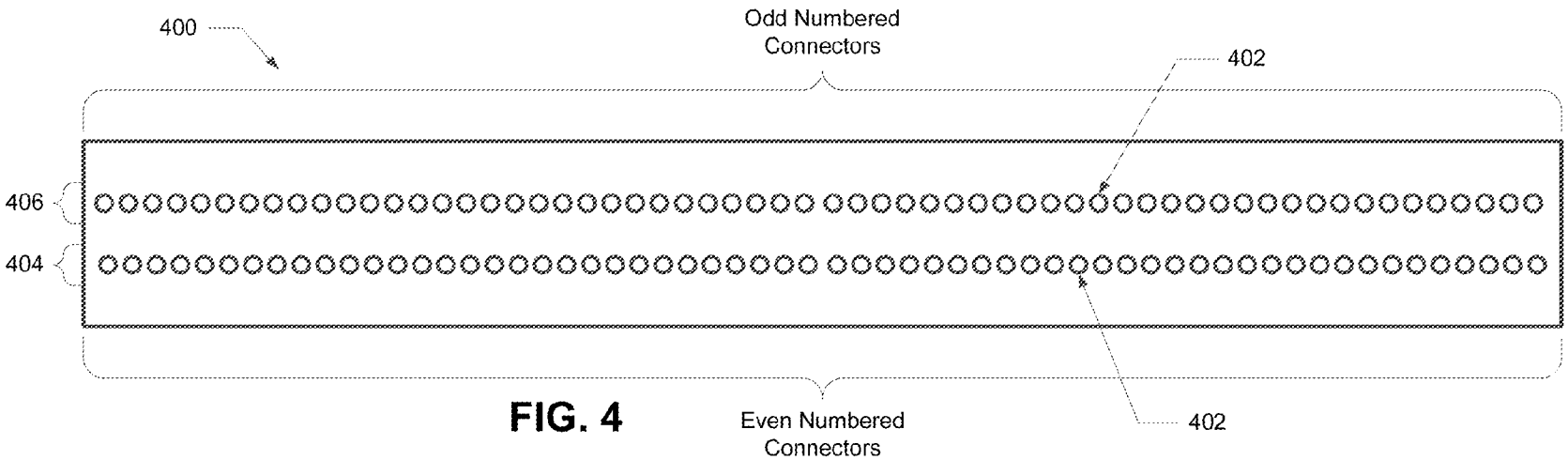
FIG. 4 is an illustration of an embodiment of an interface connector comprised of two rows of connectors.

FIG. 4 is an illustration of an embodiment of an interface connector 400 comprised of two rows of connectors 402. The connectors 402 are numbered such that all connectors 402 in one row 404 of the interface connector 400 are even-numbered and all connectors 402 in the other row 406 are all odd numbered.

Figure 5:
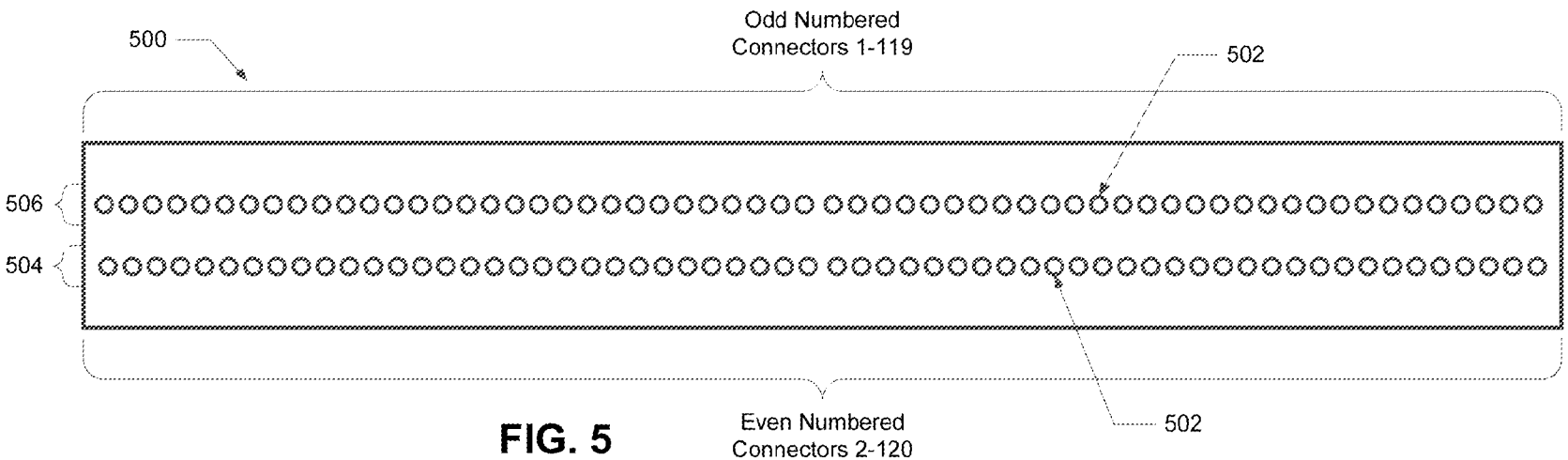
FIG. 5 is an illustration of an embodiment of an interface connector comprised of 120 connectors.
Figure 6:
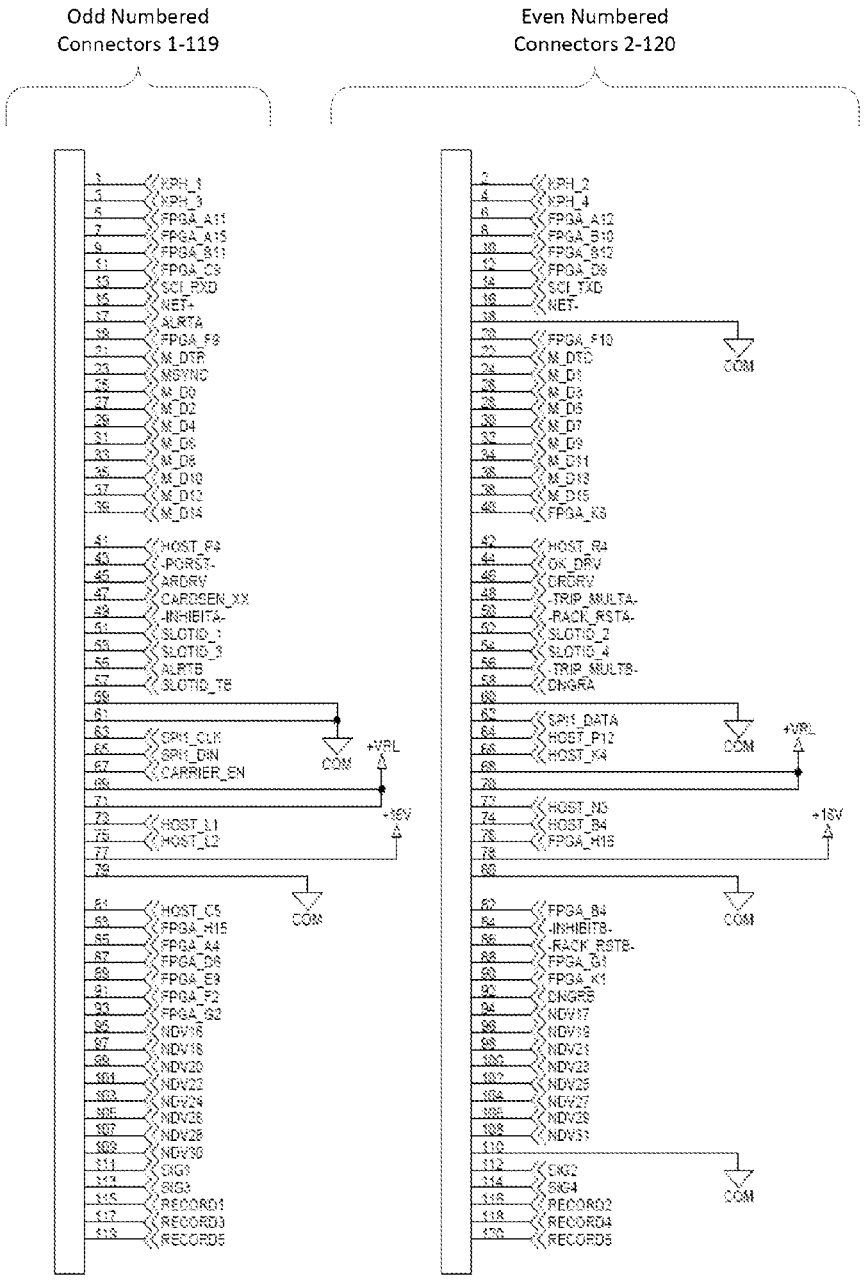
FIG. 6 is an embodiment of a pin-out diagram for the interface connector.

FIG. 5 is an illustration of an embodiment of an interface connector 500 comprised of 120 connectors 502. The connectors 502 are divided into two rows 504, 506 having 60 connectors 502 in each row 504, 506. The connectors 502 are numbered such that all connectors 502 in one row 504 of the interface connector 500 are even-numbered (numbered 2 through 120) and all connectors 502 in the other row 506 are all odd numbered (numbered 1 through 119). FIG. 6 is an embodiment of a pin-out diagram for the interface connector. This pin-out diagram is for connecting an ancillary board of a machinery protection and monitoring system with a second circuit board. In this embodiment, the second circuit board is a portable core module (PCM) used to upgrade the machinery protection and monitoring system. In particular, the pin-out diagram of FIG. 6 is for connecting an ancillary board of a Bently Nevada model 3300 machinery protection and monitoring system to a PCM that can upgrade the system from a model 3300 series to a model 3500 series machinery protection and monitoring system. As shown in FIG. 6, at least connectors (also referred to herein as "pins") 1-4, 13-18, 43-61, 68-71, 77, 78, 79, 80, 84, 86, 92 and 94-120 provide electrical paths for general circuit connections between the first circuit board and the second circuit board; connectors 41, 42, 62-67, 72-75 and 81 provide electrical paths for host processor connections between the first circuit board and the second circuit board; and connectors 5-12, 19-40, 76, 82, 83, 85, 87-91 and 93 provide electrical paths for field programmable gate array (FPGA) connections between the first circuit board and the second circuit board. More specifically, connectors 59, 61, 79, 18, 60, 80, 110, 69, 71, 68, 70, 77, and 78 are power connections for electronic components on the first circuit board or the second circuit board. In one aspect, the electronic components on the first circuit board or the second circuit board comprise a host processor and FPGA. Connectors 1-4 provide electrical paths for a plurality of Keyphasor® (registered trademark of the General Electric Company) signals between the first circuit board and the second circuit board. A Keyphasor® signal is used in machine monitoring and diagnostics. It is an electric pulse, or trigger, which is derived from a point on a rotating shaft. It serves as a zero phase reference for other measurements concerning a rotor and a machine. Connector 63 provides the electrical path for a clock signal between the first circuit board and the second circuit board.

In particular, Table I, below, provides full connection information for an interface connector used to connect a Bently Nevada ancillary board to a Bently Nevada PCM including general circuit connections, host processor connections, and FPGA connections.

TABLE I

| Schematic Node Name | I/O | Pin Number | Description |
|---|---|---|---|
| General Circuit Connections | | | |
| ALRTA | O | 17 | Alert Relay status and driver for Quad relay I/Os. Channel A. |
| GND | PWR | 59 | Signal Common. |
| GND | PWR | 61 | Signal Common. |
| GND | PWR | 79 | Signal Common. |
| GND | PWR | 18 | Signal Common. |
| DNGRA | O | 58 | Danger Relay status and driver for Quad relay I/Os. Channel A. |
| GND | PWR | 60 | Signal Common. |
| GND | PWR | 80 | Signal Common. |
| DNGRB | O | 92 | Danger Relay status and driver for Quad relay I/Os. Channel B. |
| GND | PWR | 110 | Signal Common. |
| +VRL | PWR | 69 | Positive Rough Supply. Input Voltage is 6 v to 15 v. Maximum Power consumption is 2.5 W. Maximum current per input pin is 0.25 amps. |
| +VRL | PWR | 71 | Positive Rough Supply. Input Voltage is 6 v to 15 v. Maximum Power consumption is 2.5 W. Maximum current per input pin is 0.25 amps. |
| +VRL | PWR | 68 | Positive Rough Supply. Input Voltage is 6 v to 15 v. Maximum Power consumption is 2.5 W. Maximum current per input pin is 0.25 amps. |
| +VRL | PWR | 70 | Positive Rough Supply. Input Voltage is 6 v to 15 v. Maximum Power consumption is 2.5 W. Maximum current per input pin is 0.25 amps. |
| +16V | PWR | 77 | Positive Regulated Supply. Input Voltage range is 15.50 v to 17.50 v. Maximum Power consumption is 1.65 W. Maximum current per input pin is 0.25 amps. |
| +16V | PWR | 78 | Positive Regulated Supply. Input Voltage range is 15.50 v to 17.50 v. Maximum Power consumption is 1.65 W. Maximum current per input pin is 0.25 amps. |
| ALRTB | O | 55 | Alert Relay status and driver for Quad relay I/Os. Channel B. |
| SIG1 | I | 111 | Dedicated channel 1 analog signal input (+1 to −24 volts) |
| SIG2 | I | 112 | Dedicated channel 2 analog signal input (+1 to −24 volts) |
| SIG3 | I | 113 | Dedicated channel 3 analog signal input (+1 to −24 volts) |
| SIG4 | I | 114 | Dedicated channel 4 analog signal input (+1 to −24 volts) |
| -PORST- | O | 43 | Dedicated Power On Reset Strobe. Resets when Low. Normal operation when high. |
| SCI_RXD | I | 13 | Dedicated SCI Receive from the system monitor. |
| SCI_TXD | O | 14 | Dedicated SCI Transmit to the system monitor. |
| NET+ | O | 15 | Dedicated Neuron Communication line to the System Monitor. |
| NET− | O | 16 | Dedicated Neuron Communication line to the System Monitor. |
| OK_DRV | O | 44 | Dedicated OK Relay Drive. Open Drain. |
| ARDRV | O | 45 | Dedicated Alert (First Alarm) relay drivel. 0 = no Alarm. 1 = Alarm. |

TABLE I-continued

| Schematic Node Name | I/O | Pin Number | Description |
|---|---|---|---|
| DRDRV | O | 46 | Dedicated Danger (Second Alarm) relay drivel. 0 = no Alarm. 1 = Alarm. |
| CARDSEN_XX | I | 47 | Dedicated card sense line input. The System Monitor will drive this line high. When high, the System Monitor expects an SCI response. A 10K resister pulls down this line. |
| SLOTID_1 | I | 51 | Bit 1 of 4 of the slot position identification code. The state of this pin is defined by external circuitry. This card drives the external circuitry by providing a 3.3 v power line. |
| SLOTID_2 | I | 52 | Bit 2 of 4 of the slot position identification code. The state of this pin is defined by external circuitry. This card drives the external circuitry by providing a 3.3 v power line. |
| SLOTID_3 | I | 53 | Bit 3 of 4 of the slot position identification code. The state of this pin is defined by external circuitry. This card drives the external circuitry by providing a 3.3 v power line. |
| SLOTID_4 | I | 54 | Bit 4 of 4 of the slot position identification code. The state of this pin is defined by external circuitry. This card drives the external circuitry by providing a 3.3 v power line. |
| SLOTID_T | I | 57 | This bit identifies Top or Bottom slot position. |
| B | | | The state of this pin is defined by external circuitry. This card drives the external circuitry by providing a 3.3 v power line. |
| KPH_1 | I | 1 | Dedicated conditioned Keyphasor 1 input. This line goes to the FPGA. |
| KPH_2 | I | 2 | Dedicated conditioned Keyphasor 2 input. This line goes to the FPGA. |
| KPH_3 | I | 3 | Dedicated conditioned Keyphasor 3 input. This line goes to the FPGA. |
| KPH_4 | I | 4 | Dedicated conditioned Keyphasor 4 input. This line goes to the FPGA. |
| -TRIP_MULTA- | I | 48 | Dedicated Trip Multiply input from the System Monitor. This line goes to the FPGA. |
| -TRIP_MULTB- | I | 56 | Dedicated Trip Multiply input from the System Monitor. This line goes to the FPGA. |
| -INHIBITA- | I | 49 | Dedicated Trip Multiply input from the System Monitor. This line goes to the FPGA. |
| -INHIBITB- | I | 84 | Dedicated Trip Multiply input from the System Monitor. This line goes to the FPGA. |
| -RACK_RSTA- | I | 50 | Dedicated Trip Multiply input from the System Monitor. This line goes to the FPGA. |
| -RACK_RSTB- | I | 86 | Dedicated Trip Multiply input from the System Monitor. This line goes to the FPGA. |
| NDV16 | I | 95 | External Node Voltage input. Input voltage must be between 0 and +2.50 vdc with in input resistance of less than 2.5K ohms. |
| NDV17 | I | 94 | External Node Voltage input. Input voltage must be between 0 and +2.50 vdc with in input resistance of less than 2.5K ohms. |
| NDV18 | I | 97 | External Node Voltage input. Input voltage must be between 0 and +2.50 vdc with in input resistance of less than 2.5K ohms. |
| NDV19 | I | 96 | External Node Voltage input. Input voltage must be between 0 and +2.50 vdc with in input resistance of less than 2.5K ohms. |
| NDV20 | I | 99 | External Node Voltage input. Input voltage must be between 0 and +2.50 vdc with in input resistance of less than 2.5K ohms. |
| NDV21 | I | 98 | External Node Voltage input. Input voltage must be between 0 and +2.50 vdc with in input resistance of less than 2.5K ohms. |
| NDV22 | I | 101 | External Node Voltage input. Input voltage must be between 0 and +2.50 vdc with in input resistance of less than 2.5K ohms. |
| NDV23 | I | 100 | External Node Voltage input. Input voltage must be between 0 and +2.50 vdc with in input resistance of less than 2.5K ohms. |
| NDV24 | I | 103 | External Node Voltage input. Input voltage must be between 0 and +2.50 vdc with in input resistance of less than 2.5K ohms. |
| NDV25 | I | 102 | External Node Voltage input. Input voltage must be between 0 and +2.50 vdc with in input resistance of less than 2.5K ohms. |
| NDV26 | I | 105 | External Node Voltage input. Input voltage must be between 0 and +2.50 vdc with in input resistance of less than 2.5K ohms. |
| NDV27 | I | 104 | External Node Voltage input. Input voltage must be between 0 and +2.50 vdc with in input resistance of less than 2.5K ohms. |
| NDV28 | I | 107 | External Node Voltage input. Input voltage must be between 0 and +2.50 vdc with in input resistance of less than 2.5K ohms. |
| NDV29 | I | 106 | External Node Voltage input. Input voltage must be between 0 and +2.50 vdc with in input resistance of less than 2.5K ohms. |
| NDV30 | I | 109 | External Node Voltage input. Input voltage must be between 0 and +2.50 vdc with in input resistance of less than 2.5K ohms. |
| NDV31 | I | 108 | External Node Voltage input. Input voltage must be between 0 and +2.50 vdc with in input resistance of less than 2.5K ohms. |
| RECORD1 | O | 115 | Channel 1, 4 to 20 ma recorder output. 0 to 600 ohm load. |
| RECORD2 | O | 116 | Channel 2, 4 to 20 ma recorder output. 0 to 600 ohm load. |
| RECORD3 | O | 117 | Channel 3, 4 to 20 ma recorder output. 0 to 600 ohm load. |
| RECORD4 | O | 118 | Channel 4, 4 to 20 ma recorder output. 0 to 600 ohm load. |
| RECORD5 | O | 119 | Channel 5, 4 to 20 ma recorder output. 0 to 600 ohm load. |
| RECORD6 | O | 120 | Channel 6, 4 to 20 ma recorder output. 0 to 600 ohm load. |
| Host Processor Connections | | | |
| HOST_P4 | I/O | 41 | SPI1_CS0, UART2_TXD, GP5_13. |
| HOST_R4 | I/O | 42 | SPI1_ENA, UART2_RXD, GP5_12. |
| SPI1_CLK | O | 63 | SPI1 CLK. Master clock. Used internal, but may be used external in conjunction with a designated chip select line. A 49.9K ohm resister is connected from this pin to common. |
| SPI1_DATA | O | 62 | SPI1 DATA. Master data out. Used internal, but may be used external in conjunction with a designated chip select line. |
| SPI1_DIN | I | 65 | SPI1 DATA. Slave data in. Used internal, but may be used external in conjunction with a designated chip select line. |
| CARRIER_EN | O | 67 | Dedicated as the external SPI Chip Select line. This is used to select the |

TABLE I-continued

| Schematic Node Name | I/O | Pin Number | Description |
|---|---|---|---|
| | | | carrier board identification FLASH. |
| HOST_K4 | I/O | 66 | GP4_10. |
| HOST_L1 | I/O | 73 | GP4_11. |
| HOST_P12 | I/O | 64 | GP2_8. |
| HOST_N3 | I/O | 72 | GP5_10 |
| HOST_C5 | I/O | 81 | ECAP0, GP2_12 |
| HOST_B4 | I/O | 74 | ECAP1, GP2_15 |
| HOST_L2 | I/O | 75 | ECAP2, GP4_12 |
| | | FPGA Connections | |
| M_D0 | I/O | 25 | Management data bus bit 0. The management data bus is a function of the FPGA |
| M_D1 | I/O | 24 | Management data bus bit 1. The management data bus is a function of the FPGA |
| M_D2 | I/O | 27 | Management data bus bit 2. The management data bus is a function of the FPGA |
| M_D3 | I/O | 26 | Management data bus bit 3. The management data bus is a function of the FPGA |
| M_D4 | I/O | 29 | Management data bus bit 4. The management data bus is a function of the FPGA |
| M_D5 | I/O | 28 | Management data bus bit 5. The management data bus is a function of the FPGA |
| M_D6 | I/O | 31 | Management data bus bit 6. The management data bus is a function of the FPGA |
| M_D7 | I/O | 30 | Management data bus bit 7. The management data bus is a function of the FPGA |
| M_D8 | I/O | 33 | Management data bus bit 8. The management data bus is a function of the FPGA |
| M_D9 | I/O | 32 | Management data bus bit 9. The management data bus is a function of the FPGA |
| M_D10 | I/O | 35 | Management data bus bit 10. The management data bus is a function of the FPGA |
| M_D11 | I/O | 34 | Management data bus bit 11. The management data bus is a function of the FPGA |
| M_D12 | I/O | 37 | Management data bus bit 12. The management data bus is a function of the FPGA |
| M_D13 | I/O | 36 | Management data bus bit 13. The management data bus is a function of the FPGA |
| M_D14 | I/O | 39 | Management data bus bit 14. The management data bus is a function of the FPGA |
| M_D15 | I/O | 38 | Management data bus bit 15. The management data bus is a function of the FPGA |
| M_DTR | I | 21 | Management Data Transmit Receive from the System Monitor. Used to hand shake with the System Monitor. |
| M_DTC | O | 22 | Management Data Transmit Control to the System Monitor. Used to hand shake with the System Monitor. |
| MSYNC | I | 23 | Management Synchronization line from the System Monitor. |
| FPGA_A11 | I/O | 5 | Input or output to the FPGA. |
| FPGA_A12 | I/O | 6 | Input or output to the FPGA. |
| FPGA_A15 | I/O | 7 | Input or output to the FPGA. |
| FPGA_B10 | I/O | 8 | Input or output to the FPGA. |
| FPGA_B11 | I/O | 9 | Input or output to the FPGA. |
| FPGA_B12 | I/O | 10 | Input or output to the FPGA. |
| FPGA_C9 | I/O | 11 | Input or output to the FPGA. |
| FPGA_D9 | I/O | 12 | Input or output to the FPGA. |
| FPGA_F9 | I/O | 19 | Input or output to the FPGA. |
| FPGA_F10 | I/O | 20 | Input or output to the FPGA. |
| FPGA_A4 | I/O | 85 | Input or output to the FPGA. |

TABLE I-continued

| Schematic Node Name | I/O | Pin Number | Description |
|---|---|---|---|
| FPGA_B4 | I/O | 82 | Input or output to the FPGA. |
| FPGA_D6 | I/O | 87 | Input or output to the FPGA. |
| FPGA_H15 | I/O | 83 | Input or output to the FPGA. |
| FPGA_H16 | I/O | 76 | Input or output to the FPGA. |
| FPGA_E9 | I/O | 89 | Input or output to the FPGA. |
| FPGA_F2 | I/O | 91 | Input or output to the FPGA. |
| FPGA_G2 | I/O | 93 | Input or output to the FPGA. |
| FPGA_G1 | I/O | 88 | Input or output to the FPGA. |
| FPGA_K1 | I/O | 90 | Input or output to the FPGA. |
| FPGA_K6 | I/O | 40 | Input or output to the FPGA. |

Where: EMIFA (extended memory interface) is a standard memory and peripheral interface; EMIFB is a specialized interface for SDRAM; SCI is an asynchronous serial interface; SPI is a synchronous peripheral serial interface; GP or GPIO represents standard input and output logic interface of the host processor; and ECAP represents enhanced capture port, which can be used as a general interrupt pin or a pulse width modulator output. TRIP_MULTA and TRIP_MULTB (pins 48 and 56, respectively) are indicator signals that are received by each monitor in a protection system's racks. The protection system can be configured by closing the Trip Multiply contact input on the back of the system rack. When the Trip Multiply contact is closed, it informs each monitor to increase the alarm trip level to a preset magnitude. For example, if a monitor is configured for an alarm at 3 mils of vibration, and the Trip Multiply is configured to 2×, then when the TRIP_MULT input is present (i.e., closed), the alarm setting will change from 3 mils to 6 mils. Trip Multiply is usually used during a machine start up or shut down when it can encounter higher than normal vibration. This prevents false alarms during these times of high vibration. Usually there are two pairs of channel alarms, A and B. M_D0 thru MD15 (pins 24 through 39) are management data bus signals. Each monitor in a protection monitoring system digitizes its incoming transducer signals. The digitized transducer signals are organized and stored into packets and sent to the system monitor. The system monitor organizes all the packets from each monitor and sends them to software residing on a server or a personal computer. This data is used to provide displays and graphs that help manage a monitored asset. Because this data is used for managing their asset, rather than for protection against sudden failures where alarming is needed, this data is referred to as management data and the bus used to move the data from each individual monitor to the system monitor is called the management bus. M_D0 thru M_D15 is a 16 bit wide data bus that is used to move the management data where M_D0 is bit 0 on the management bus and M_D15 is the last bit or bit 15 on the management bus. M_DTC, M_DTR and MSYNC are handshaking or control lines that are used in association with the management data bus to properly synchronize and move the data.

Figure 7:
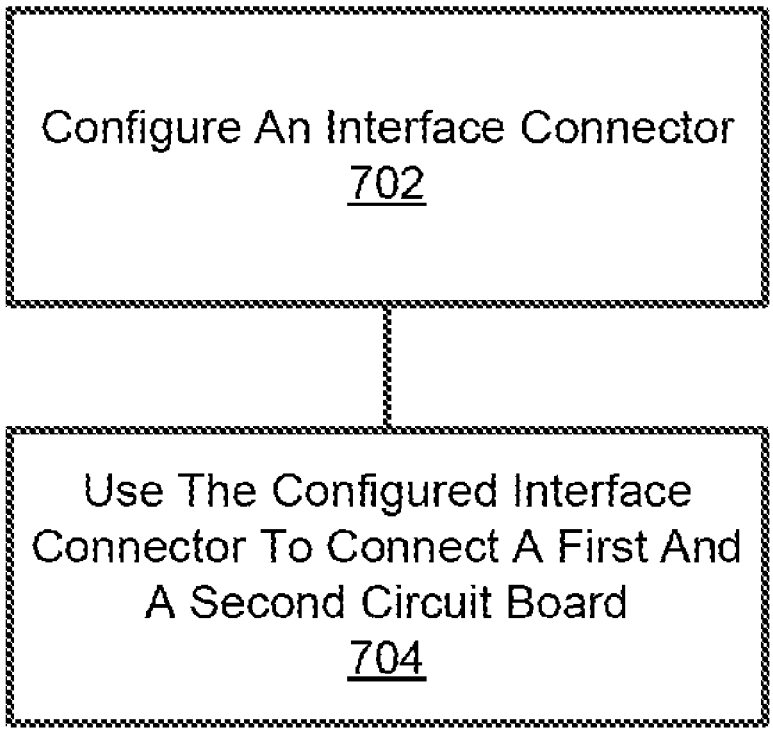
FIG. 7 is a flowchart illustrating one embodiment of a method of connecting two circuit boards.

FIG. 7 is a flowchart illustrating one embodiment of a method of connecting two circuit boards. At step 702, an interface connector is configured such that connectors 1-4, 13-18, 43-61, 68-71, 77, 78, 79, 80, 84, 86, 92 and 94-120 are assigned to provide electrical paths for general circuit connections between the first circuit board and the second circuit board; connectors 41, 42, 62-67, 72-75 and 81 are assigned to provide electrical paths for host processor connections between the first circuit board and the second circuit board; and connectors 5-12, 19-40, 76, 82, 83, 85, 87-91 and 93 are assigned to provide electrical paths for field programmable gate array (FPGA) connections between the first circuit board and the second circuit board. The interface connector is comprised of a casing and a plurality of electrically conductive connectors insulated from one another within the casing, each connector having a first end and a second end. The first end connects to a first circuit board and the second end connects to a second circuit board. The plurality of connectors form a first row and a second row where the first row comprised of evenly-numbered connectors and said second row is formed of odd-numbered connectors. In one aspect, the plurality of electrically conductive connectors comprises at least 120 connectors. In one aspect, configuring the interface connector such that connectors 1-4, 13-18, 43-61, 68-71, 77, 78, 79, 80, 84, 86, 92 and 94-120 provide electrical paths for general circuit connections between the first circuit board and the second circuit board comprises configuring connectors 59, 61, 79, 18, 60, 80, 110, 69, 71, 68, 70, 77, and 78 as power connections for electronic components on the first circuit board or the second circuit board. In one aspect, he electronic components the first circuit board or the second circuit board comprise a host processor and FPGA. In one aspect, configuring the interface connector such that connectors 1-4, 13-18, 43-61, 68-71, 77, 78, 79, 80, 84, 86, 92 and 94-120 provide electrical paths for general circuit connections between the first circuit board and the second circuit board comprises configuring connectors 1-4 to provide electrical paths for a plurality of Keyphasor® signals between the first circuit board and the second circuit board. In one aspect, configuring the interface connector such that connectors 41, 42, 62-67, 72-75 and 81 provide electrical paths for host processor connections between the first circuit board and the second circuit board comprises configuring connector 63 provide the electrical path for a clock signal between the first circuit board and the second circuit board. At step 704, the configured interface connector is used to connect a first and a second circuit board.

As described above and as will be appreciated by one skilled in the art, embodiments of the present invention may be configured as a device, system, or method. Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

Throughout this application, various publications may be referenced. The disclosures of these publications in their entireties are hereby incorporated by reference into this application in order to more fully describe the state of the art to which the devices, methods and systems pertain.

Many modifications and other embodiments of the inventions set forth herein will come to mind to one skilled in the art to which these embodiments of the invention pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A method of connecting an upgrade module to a machine monitoring system, said method comprising:

providing a machine monitoring system having a first circuit board;

providing an upgrade module for the machine monitoring system, said upgrade module comprising a second circuit board;

providing an interface connector, wherein said interface connector is comprised of a casing and a plurality of electrically conductive connectors insulated from one another within the casing, each connector having a first end and a second end, wherein the first end connects to the first circuit board and the second end connects to the second circuit board, wherein said plurality of connectors form a first row and a second row, said first row comprised of evenly-numbered connectors and said second row comprised of odd-numbered connectors;

configuring the interface connector to transmit signals between the first circuit board and the second circuit board for operation of the machine monitoring system, wherein said configuring comprises:

connectors 1-4, 13-18, 43-61, 68-71, 77, 78, 79, 80, 84, 86, 92 and 94-120 provide electrical paths for general circuit connections between the first circuit board and the second circuit board;

connectors 41, 42, 62-67, 72-75 and 81 provide electrical paths for host processor connections between the first circuit board and the second circuit board; and connectors 5-12, 19-40, 76, 82, 83, 85, 87-91 and 93 provide electrical paths for field programmable gate array (FPGA) connections between the first circuit board and the second circuit board; and connecting the first circuit board and the second circuit board using the configured interface connector.

2. The method of claim 1, wherein the plurality of electrically conductive connectors comprises at least 120 connectors.

3. The method of claim 1, wherein configuring the interface connector such that connectors 1-4, 13-18, 43-61, 68-71, 77, 78, 79, 80, 84, 86, 92 and 94-120 provide electrical paths for general circuit connections between the first circuit board and the second circuit board comprises configuring connectors 59, 61, 79, 18, 60, 80, 110, 69, 71, 68, 70, 77, and 78 as power connections for electronic components on the first circuit board or the second circuit board.

4. The method of claim 3, wherein electronic components of the first circuit board or the second circuit board comprise a host processor and a field programmable gate array (FPGA).

5. The method of claim 1, wherein configuring the interface connector such that connectors 1-4, 13-18, 43-61, 68-71, 77, 78, 79, 80, 84, 86, 92 and 94-120 provide electrical paths for general circuit connections between the first circuit board and the second circuit board comprises configuring connectors 1-4 to provide electrical paths for a plurality of keyphasor signals between the first circuit board and the second circuit board.

6. The method of claim 1, wherein configuring the interface connector such that connectors 41, 42, 62-67, 72-75 and 81 provide electrical paths for host processor connections between the first circuit board and the second circuit board comprises configuring connector 63 provide the electrical path for a clock signal between the first circuit board and the second circuit board.

7. The method of claim 1, wherein connecting the first circuit board and the second circuit board using the configured interface connector comprises electrically connecting the second circuit board to a circuit board for a Bently Nevada machine monitoring system.

8. The method of claim 1, wherein configuring the interface connector such that connectors 1-4, 13-18, 43-61, 68-71, 77, 78, 79, 80, 84, 86, 92 and 94-120 provide electrical paths for general circuit connections between the first circuit board and the second circuit board comprises configuring connectors 48 and 56 as electrical paths for trip multiplier signals between the first circuit board and the second circuit board.

9. The method of claim 1, wherein configuring the interface connector such that connectors 5-12, 19-40, 76, 82, 83, 85, 87-91 and 93 provide electrical paths for field programmable gate array (FPGA) connections between the first circuit board and the second circuit board comprises configuring connectors 24 through 39 as electrical paths for management data bus signals between the first circuit board and the second circuit board.

10. A system for connecting an upgrade module to a machine monitoring system, said system comprised of:

a machine monitoring system, wherein said machine monitoring is further comprised of a first circuit board;

an upgrade module for the machine monitoring system, said upgrade module comprising a second circuit board; and an interface connector, wherein the interface connector is used to connect the first circuit board of the machine monitoring system to the second circuit board of the upgrade module and the interface connector is comprised of:

a casing; and at least 120 electrically conductive connectors insulated from one another within the casing, each connector having a first end and a second end, wherein the first end connects to the first circuit board and the second end connects to the second circuit board, wherein said plurality of connectors form a first row and a second row, said first row comprised of evenly-numbered connectors and said second row comprised of odd-numbered connectors, wherein said plurality of connectors are configured to transmit signals between the first circuit board and the second circuit board for operation of the machine monitoring system, said configuring comprises:

connectors 1-4, 13-18, 43-61, 68-71, 77, 78, 79, 80, 84, 86, 92 and 94-120 provide electrical paths for general circuit connections between the first circuit board and the second circuit board, wherein connectors 59, 61, 79, 18, 60, 80, 110, 69, 71, 68, 70, 77, and 78 are power connections for electronic components on the first circuit board or the second circuit board, connectors 1-4 provide electrical paths for a plurality of keyphasor signals between the first circuit board and the second circuit board, and 48 and 56 provide electrical paths for trip multiplier signals between the first circuit board and the second circuit board;

connectors 41, 42, 62-67, 72-75 and 81 provide electrical paths for host processor connections between the first circuit board and the second circuit board, wherein connector 63 provides the electrical path for a clock signal between the first circuit board and the second circuit board; and connectors 5-12, 19-40, 76, 82, 83, 85, 87-91 and 93 provide electrical paths for field programmable gate array (FPGA) connections between the first circuit board and the second circuit board, wherein connectors 24 through 39 provide electrical paths for management data bus signals between the first circuit board and the second circuit board.

11. The system of claim 10, wherein electronic components on the first circuit board or the second circuit board comprise a host processor and a field programmable gate array (FPGA).

12. The system of claim 10, wherein the first end of each of the plurality of connectors comprises a female end for connecting to the first circuit board.

13. The system of claim 10, wherein the first end of each of the plurality of connectors comprises a male end for connecting to the first circuit board.

14. The system of claim 10, wherein the second end of each of the plurality of connectors comprises a female end for connecting to the second circuit board.

15. The system of claim 10, wherein the second end of each of the plurality of connectors comprises a male end for connecting to the second circuit board.

16. The system of claim 10, wherein the first circuit board is a circuit board for a Bently Nevada machine monitoring system and the interface connector is used to electrically connect the second circuit board to the circuit board for a Bently Nevada machine monitoring system.

* * * * *